US010760252B2

(12) United States Patent
Tash

(10) Patent No.: US 10,760,252 B2
(45) Date of Patent: Sep. 1, 2020

(54) AUTOMATIC AIR RELEASE PLUNGER

(71) Applicant: George Tash, Somis, CA (US)

(72) Inventor: George Tash, Somis, CA (US)

(73) Assignees: George Tash, Somis, CA (US), As Trustee of Community Trust; Debra Tash, Somis, CA (US), As Trustee of Community Trust ( * ) Notice: Subject to any disclaimer, the term of this patent is extended or adjusted under 35 U.S.C. 154(b) by 15 days.

(21) Appl. No.: 16/262,524

(22) Filed: Jan. 30, 2019

(65) Prior Publication Data

US 2020/0240127 A1 Jul. 30, 2020

(51) Int. Cl.
*E03C 1/308* (2006.01)

(52) U.S. Cl.
CPC ..... *E03C 1/308* (2013.01)

(58) Field of Classification Search
CPC ..... E03C 1/30; E03C 1/308
USPC ..... 4/255.12, 255.11, 255.01
See application file for complete search history.

(56) References Cited

U.S. PATENT DOCUMENTS 1,852,071 A * 4/1932 Becker ..... D06F 5/02 4/255.11
1,972,114 A * 9/1934 Stephenson ..... E03C 1/308 4/255.12
4,566,139 A * 1/1986 Jeng ..... E03C 1/308 4/255.12
4,622,702 A * 11/1986 Allen ..... E03C 1/308 4/255.12
4,745,641 A * 5/1988 Tash ..... E03C 1/308 4/255.11
6,192,525 B1 * 2/2001 Tash ..... E03C 1/308 4/255.11
6,216,283 B1 * 4/2001 Tash ..... A61K 31/51 4/255.01
6,393,626 B1 * 5/2002 Dhillon ..... E03C 1/308 4/255.01
6,684,417 B1 * 2/2004 Schneider ..... E03C 1/308 4/255.05
6,898,807 B2 5/2005 Tash
2003/0079278 A1 * 5/2003 Tash ..... E03C 1/30 4/255.11
2004/0025235 A1 * 2/2004 Tash ..... E03D 9/00 4/255.01

* cited by examiner

*Primary Examiner* — Benjamin R Shaw
(74) *Attorney, Agent, or Firm* — Lyon & Harr, LLP; Richard T. Lyon

(57) ABSTRACT

An automatic air release plunger is provided for unclogging an obstructed drain in a plumbing fixture having undrained wastewater. The plunger includes a handle and a hollow, compressible plunger head. The plunger head is coupled to the handle at the plunger head's proximal end. The plunger head also includes a seal extending from its distal end that is capable of sealing the plunger head to a drain opening of the plumbing fixture. Additionally, the handle and plunger head include automatic air release features that allow air to flow along an air-escape path from inside of the hollow plunger head into a void formed in the interior of the handle, and thereafter into a channel which extends from the proximal end of the plunger head to a gap at a proximal end of the handle where the air is released whenever the plunger head is compressed.

25 Claims, 11 Drawing Sheets

AUTOMATIC AIR RELEASE PLUNGER

BACKGROUND

Drains such as those in toilets, sinks, and tubs are typically unclogged by using a plunger comprised of a deformable head mounted on the end of an elongated handle or shaft. Plunger head designs typically include an air chamber or bellows coupled to a seal. During an unclogging operation, a plunger head seal is held over, or inserted into, the mouth of the drain while the plunger handle is reciprocated in an upward and downward motion that alternately contracts and enlarges the space within the head air chamber. This reciprocating motion then creates an alternating pressure and suction force in the drain passage that is often sufficient to dislodge an obstruction in the drain.

SUMMARY

One exemplary automatic air release (AAR) plunger implementation for unclogging an obstructed drain in a plumbing fixture having undrained wastewater described herein includes a handle and a hollow, compressible plunger head. The plunger head is open at both a proximal and distal end, and is coupled to the handle at the proximal end of the plunger head. The plunger head also includes a seal extending from its distal end. This seal is capable of sealing the plunger head to a drain opening of the plumbing fixture. In addition, the handle and plunger head include automatic air release features that allow air to flow along an air-escape path from inside of the hollow plunger head into a void formed in the interior of the handle, and thereafter into a channel which extends from the proximal end of the plunger head to a gap that is open to the exterior of the AAR plunger at a proximal end of the handle whenever the plunger head is compressed. The air ultimately escapes out the gap.

In another exemplary AAR plunger implementation having multiple air escape paths, the automatic air release features allow air to flow from inside of the hollow plunger head into multiple voids formed in the interior of the handle, and thereafter into multiple channels which extend from the proximal end of the plunger head to a gap that is open to the exterior of the AAR plunger at a proximal end of the handle whenever the plunger head is compressed. The air ultimately escapes out the gap in this implementation as well.

Yet another exemplary AAR plunger implementation described herein also includes a handle and a hollow, compressible plunger head. As with other implementations, the plunger head is open at both a proximal and distal end, and is coupled to the handle at the proximal end of the plunger head. The plunger head also includes a seal extending from its distal end. This seal is capable of sealing the plunger head to a drain opening of the plumbing fixture. The handle and plunger head include automatic air release features that allow air to flow along an air-escape path from the inside of the hollow plunger head into a void formed in the interior of the handle and thereafter into one or more channels which extend from the proximal end of the plunger head to a gap that is open to the exterior of the plunger at a proximal end of the handle whenever the plunger head is compressed. However, in this implementation, the automatic air release features include a single hollow ring-shaped projection that wraps around the circumference of the handle and forms the void, a shoulder located at a proximal-most end of the plunger head stub, and a tab. The tab interferes with the shoulder of the plunger head and the proximal end of the handle so as to create the aforementioned gap therebetween.

Still another exemplary AAR plunger implementation described herein includes a handle and a hollow, compressible plunger head. As with other implementations, the plunger head is open at both a proximal and distal end, and is coupled to the handle at the proximal end of the plunger head. The plunger head also includes a seal extending from its distal end. This seal is capable of sealing the plunger head to a drain opening of the plumbing fixture. The handle and plunger head include automatic air release features that allow air to flow along an air-escape path from the inside of the hollow plunger head into a void formed in the interior of the handle and thereafter into one or more channels which extend from the proximal end of the plunger head to a gap that is open to the exterior of the plunger at a proximal end of the handle whenever the plunger head is compressed. However, in this implementation, the automatic air release features include an annular indentation that wraps around the circumference of the plunger head stub, and a shoulder located at a proximal-most end of the plunger head stub, and a tab. The tab interferes with the shoulder of the plunger head and the proximal end of the handle so as to create the aforementioned gap therebetween.

It should be noted that the foregoing Summary is provided to introduce a selection of concepts, in a simplified form, that are further described below in the Detailed Description. This Summary is not intended to identify key features or essential features of the claimed subject matter, nor is it intended to be used as an aid in determining the scope of the claimed subject matter. Its sole purpose is to present some concepts of the claimed subject matter in a simplified form as a prelude to the more-detailed description that is presented below.

DESCRIPTION OF THE DRAWINGS

The specific features, aspects, and advantages of the AAR plunger implementations described herein will become better understood with regard to the following description, appended claims, and accompanying drawings where:

DETAILED DESCRIPTION

Figure 1:
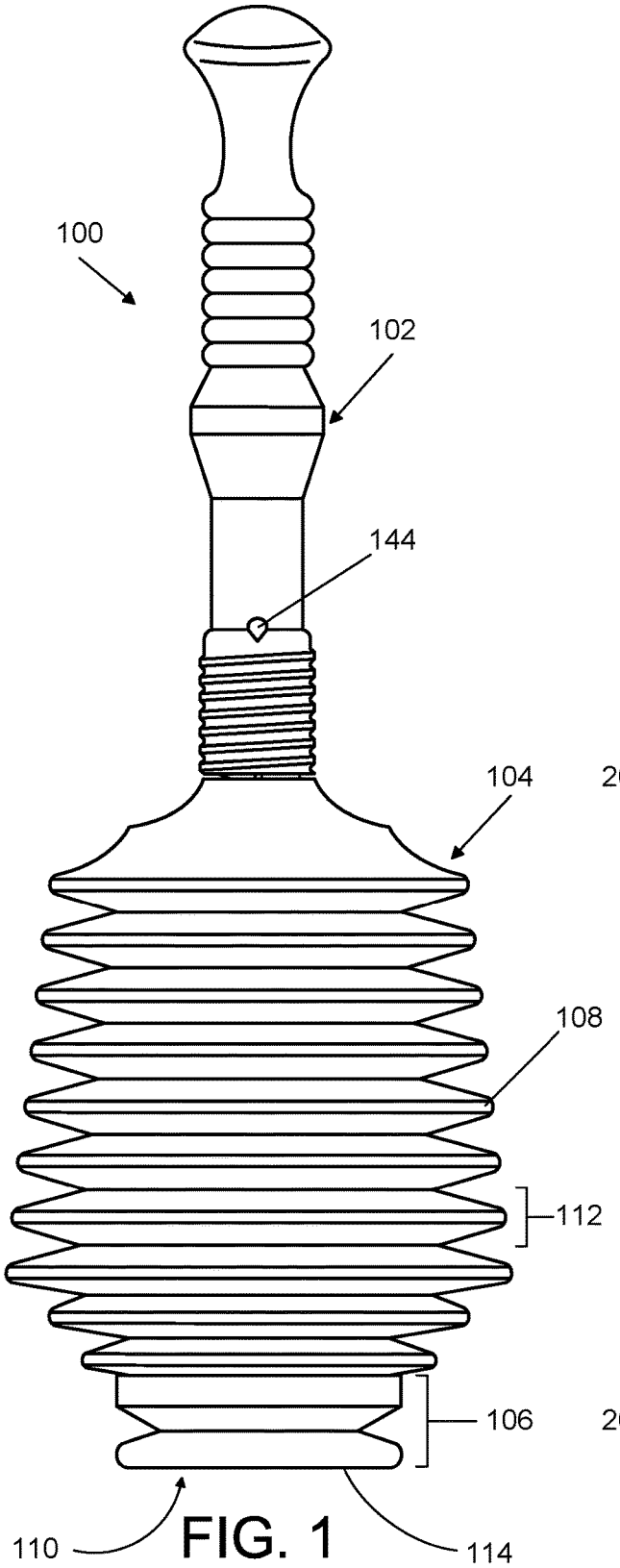
FIG. 1 is a schematic side elevation of an AAR plunger according to the present invention shown in a standing resting condition.

In the following description of automatic air release (AAR) plunger implementations reference is made to the accompanying drawings which form a part hereof, and in which are shown, by way of illustration, specific implementations in which the AAR plunger can be practiced. It is understood that other implementations can be utilized and structural changes can be made without departing from the scope of the AAR plunger implementations.

It is also noted that for the sake of clarity specific terminology will be resorted to in describing the AAR plunger implementations described herein and it is not intended for these implementations to be limited to the specific terms so chosen. Furthermore, it is to be understood that each specific term includes all its technical equivalents that operate in a broadly similar manner to achieve a similar purpose. Reference herein to "one implementation", or "another implementation", or an "exemplary implementation", or an "alternate implementation", or "one version", or "another version", or an "exemplary version", or an "alternate version", or "one variant", or "another variant", or an "exemplary variant", or an "alternate variant" means that a particular feature, a particular structure, or particular characteristics described in connection with the implementation/version/variant can be included in at least one implementation. The appearances of the phrases "in one implementation", "in another implementation", "in an exemplary implementation", "in an alternate implementation", "in one version", "in another version", "in an exemplary version", "in an alternate version", "in one variant", "in another variant", "in an exemplary variant", and "in an alternate variant" in various places in the specification are not necessarily all referring to the same implementation/version/variant, nor are separate or alternative implementations/versions/variants mutually exclusive of other implementations/versions/variants.

Furthermore, to the extent that the terms "includes," "including," "has," "contains," variants thereof, and other similar words are used in either this detailed description or the claims, these terms are intended to be inclusive, in a manner similar to the term "comprising", as an open transition word without precluding any additional or other elements.

1 Overview

Automatic air release (AAR) plunger implementations described herein are employed when the drain of a plumbing fixture (such as toilet, sink, bathtub, and so on) is clogged by an obstruction and an amount of undrained wastewater remains in the fixture. In general, an AAR plunger includes an elongated handle attached to an upper end of a compressible plunger head. In one implementation, the plunger head is a pleated bellows which is generally conical and can vary in diameter from top to bottom. The plunger head also includes a seal which is attached to its lower end. In one implementation, the seal is designed to either seat securely within a typical drain opening, or alternately, in the case where the drain opening is smaller in diameter than the seal, to form a pressure seal around the smaller drain opening. This seal forms either or both a mechanical and pressure seal with the drain hole being cleared by the plunger, depending upon the diameter of the drain opening. Alternate seal designs and shapes are used in various other implementations to adapt the AAR plunger to better interface with various sizes, shapes, and styles of drain openings. The AAR plunger can be easily and inexpensively molded, for example from durable rubber or plastic.

An operator of an AAR plunger generally unclogs a plumbing fixture drain by placing the plunger into position above a clogged drain such that the plunger head seal interfaces with the opening of the drain. Thus, at least part of the AAR plunger head is surrounded by undrained wastewater. Next, as force is applied downward on the handle, the plunger head compresses, and the portion of the seal in contact with the drain opening forms a mechanical and/or a pressure/suction seal with the drain opening, depending upon the size of the drain opening. Consequently, the pressure generated by compression of the plunger head is directed through the sealing structure and into the drain in the direction of the obstruction. Next, as the handle is then pulled upwards, a suction force is applied to the obstruction in the drain. These upward and downward motions are repeated creating reciprocating pressure and suction forces that dislodge an obstruction from within the drain, thereby facilitating clearing of the drain.

More particularly, one exemplary automatic air release plunger implementation includes a handle and a hollow, compressible plunger head. The plunger head is open at both a proximal and distal end, and is coupled to the handle at the proximal end of the plunger head. The plunger head also includes a seal extending from its distal end. This seal is capable of sealing the plunger head to a drain opening of the plumbing fixture. In addition, the handle and plunger head include automatic air release features that allow air to flow along an air-escape path from inside of the hollow plunger head into a void formed in the interior of the handle, and thereafter into a channel which extends from the proximal end of the plunger head to a gap that is open to the exterior of the AAR plunger at a proximal end of the handle whenever the plunger head is compressed. The air ultimately escapes out the gap. The automatic air release features can also in some circumstances allow air to flow from the exterior of the AAR plunger along the same path but in the opposite direction whenever the plunger head is expanded. In this implementation, the proximal end of the plunger head includes a hollow stub having a coupling section that fits within a hollow coupling section forming a proximal portion of the handle. The aforementioned channel includes a slot that begins at a first end of the coupling section of the stub closest to the proximal end of the plunger head and ends at a second end of the coupling section of the stub farthest from the proximal end of the plunger head. In one version, the coupling section of the stub has male treads and the coupling section of the handle has female thread which thread onto the male threads of the stub to couple the handle to the plunger head. In this version, the plunger head stub slot extends from an outermost extent of the male threads inward past the thread roots and into the stub to a depth not penetrating an inner wall of the hollow stub. In addition, the hollow coupling section of the handle includes a ledge at the distal-most end of the hollow coupling section of the handle, the plunger head includes a shoulder located at the distal-most end of the plunger head stub as well as a stop at the proximal-most end of the plunger head stub. The plunger head stop interferes with the handle ledge whenever the handle threads are fully threaded onto the plunger head threads, thereby creating the gap between the plunger head shoulder and the proximal end of the handle. In one implementation, the interference of the stop and the handle ledge also causes the void formed in the interior of the handle to line up with a first end of the plunger head stub slot so that air from the inside of the hollow plunger head can more easily flow into the void and thereafter into the slot whenever the plunger head is compressed.

In one implementation, the aforementioned void formed in the interior of the handle includes a void formed by a hollow projection extending from the handle and that opens into the hollow coupling section of the handle. In one version, the location where this void opens into the hollow coupling section of the handle corresponds to a first end of the plunger head stub slot such that air from the inside of the hollow plunger head can more easily flow into the void and thereafter into the slot. In one version, the first end of the plunger head stub slot is made wide enough to ensure that the slot at least partially opens into the void formed in the coupling section of the handle. In another version, the void formed in the coupling section of the handle is made wide enough to ensure the void at least partially opens into the first end of the plunger head stub slot.

In one implementation which may not include a threaded connection between the plunger head and the handle, the aforementioned hollow coupling section of the handle includes a ledge at its distal-most end, and the plunger head includes a shoulder located at a proximal-most end of the plunger head stub as well as a stop at the distal-most end of the plunger head stub. The plunger head stop interferes with the handle ledge so as to create the gap between the proximal end of the handle and the shoulder of the plunger head such that air flows from a second end of the plunger head stub slot located at the second end of the coupling section of the stub farthest from the proximal end of the plunger and out of the automatic air release plunger via the gap.

In another implementation, the plunger head includes a shoulder located at the proximal-most end of the plunger head stub and a tab projecting toward the handle. The plunger head shoulder tab interferes with the proximal end of the handle so as to create the gap between the proximal end of the handle and the shoulder of the plunger head such that air flows from a second end of the plunger head stub slot located at the second end of the coupling section of the stub farthest from the proximal end of the plunger head and out of the automatic air release plunger via the gap.

In yet another implementation, the plunger head includes a shoulder located at a proximal-most end of the plunger head stub, and the handle includes a tab at its proximal end that projects toward the plunger head shoulder. The handle tab interferes with the plunger head shoulder so as to create the gap between the proximal end of the handle and the shoulder of the plunger head such that air flows from a second end of the plunger head stub slot located at the second end of the coupling section of the stub farthest from the proximal end of the plunger and out of the automatic air release plunger via the gap.

In another exemplary automatic air release plunger implementation which has multiple air escape paths, the automatic air release features allow air to flow from inside of the hollow plunger head into multiple voids formed in the interior of the handle, and thereafter into multiple channels which extend from the proximal end of the plunger head to a gap that is open to the exterior of the AAR plunger at a proximal end of the handle whenever the plunger head is compressed. The air ultimately escapes out the gap in this implementation as well. The automatic air release features can also in some circumstances allow air to flow from the exterior of the AAR plunger along the same path but in the opposite direction whenever the plunger head is expanded. In this implementation the proximal end of the plunger head includes a hollow stub having a coupling section that fits within a hollow coupling section forming a proximal portion of the handle. The aforementioned multiple channels include multiple slots, each of which begins at a first end of the coupling section of the stub closest to the proximal end of the plunger head and ends at a second end of the coupling section of the stub farthest from the proximal end of the plunger. In one version, the coupling section of the stub has male treads and the coupling section of the handle has female thread which thread onto the male threads of the stub to couple the handle to the plunger head. The hollow coupling section of the handle includes a ledge at its distal-most end, and the plunger head includes a shoulder located at the proximal-most end of the plunger head stub as well as a stop at the proximal-most end of the plunger head stub. The plunger head stop interferes with the handle ledge whenever the handle threads are fully threaded onto the plunger head threads, thereby creating the gap between the plunger head shoulder and the proximal end of the handle. In one implementation, the interference of the stop and the handle ledge also causes each of the voids formed in the interior of the handle to line up with a first end of a different one of the plunger head stub slots so that air from the inside of the hollow plunger head can more easily flow into each void and thereafter into a correspondingly-located slot whenever the plunger head is compressed. In one version, each void formed in the interior of the handle includes a void formed by a hollow projection extending from the handle and that opens into the hollow coupling section of the handle. The location where each void opens into the hollow coupling section of the handle lines up with a first end of a different one of the plunger head stub slots such that, for each void, air from the inside of the hollow plunger head flows into the void and thereafter into the correspondingly-located slot.

2.0 Automatic Air Release Plunger

FIG. 1 illustrates an exemplary implementation, in simplified form, of an AAR plunger. The AAR plunger depicted in FIG. 1 is just an example of a suitable implementation and is not intended to suggest any limitation as to the scope of use or functionality. Neither should the AAR plunger depicted in FIG. 1 be interpreted as having any dependency or requirement relating to any one or combination of the components discussed hereafter in this section. As shown in FIG. 1, the exemplary implementation of an AAR plunger 100 includes an elongated handle 102, an open-ended plunger head 104 coupled to the base (proximal end) of the handle, and a seal 106 extending from the distal end of the plunger head. The plunger head 104 and seal 106 can be made from durable flexible rubber or plastic material. The handle 102 can be made from the same material as the plunger head 104 and seal 106, or may be made from other materials such as, for example, wood, ceramic, or metal.

In the depicted implementation, the plunger head 104 is an elongated pleated bellows 108 which is generally conical and varies in diameter from top to bottom. The bellows 108 has thin walls which define a hollow interior space 110 forming the internal volume of the bellows. Further, the pleats 112 forming the bellows 108 can be of progressively greater flexibility from the top to the bottom. This allows the pleats 112 to easily and smoothly compress and nest together into a relatively small volume during use of the AAR plunger 100. The flexibility of the pleats 112 also allows the AAR plunger 100 to be adapted to drains in tight or curved spaces, as the bellows will easily bend to fit such spaces.

In alternate implementations of the AAR plunger (not shown), the shape and size of the collapsible plunger head may be modified to better accommodate different sizes and shapes of plumbing fixtures. For example, in one alternate implementation, the collapsible plunger head can have a conical pleated bellows which, unlike the plunger head depicted in FIG. 1, is of decreasing diameter from top to bottom. This alternate plunger head can also be both longer and narrower in diameter than the plunger head depicted in FIG. 1. The alternate plunger head can be, for example, better suited for use in smaller sinks and basins, such as are typically found in household bathrooms. Further, in other implementations, the collapsible plunger head can take the form of various conventional non-bellows configurations (such an inverted flexible cup) or a combination of a non-bellows and bellows configurations. As long as the plunger head has sufficient internal volume to produce satisfactory pressure and suction forces when compressed and expanded, the size and shape of the plunger head may be varied without affecting it's performance, usability or durability. For example, the plunger head may take such shapes as a sphere, an oval, a cone, a pyramid, or it may have a rectangular cross-section, or it can have a shape which is any combination of these shapes. Further, the plunger head may also comprise fanciful shapes, or any other practical shape which is pleasing.

The plunger head seal 106 depends from the bottom of the bellows 108 as illustrated in the implementation depicted in FIG. 1. The seal 106 has flexible walls with a generally annular shape and a narrow bottom end or "mouth" 114 adapted to be inserted into or over a typical plumbing fixture drain opening. The mouth 114 opens into the interior of the bellows 110 to alternately direct a pressurized wastewater flow into, then out of, the drain as the AAR plunger 100 is first compressed then expanded. In one implementation the seal 106 is relatively less flexible than the pleats 112, but is sufficiently flexible to deform inwardly when the AAR plunger 100 is inserted into a typical drain opening (such as in a toilet) to form an interference fit type mechanical seal with the walls defining the drain opening. Further, the bottom end of the seal 106 is flat. This provides the capability for the seal 106 to form a pressure seal with a surface surrounding a drain opening which is smaller in diameter than the mouth 114 of the seal. For the purpose of this disclosure, the term "pressure seal" will mean a pressure and suction or vacuum seal. The pressure seal is in effect when the AAR plunger is being compressed, and the suction or vacuum seal is in effect when the AAR plunger is being expanded. Note that the seal 106 can be formed of the same materials as the bellows 108, but of relatively different proportions of those materials than for the bellows so as to control its flexibility. Alternately, the seal 106 can be formed of the same materials using the same composition as the bellows 108, but of a relatively different thickness than the bellows so as to control its flexibility relative to the bellows. Alternate seal designs and shapes can be used in various other implementations to adapt the AAR plunger to better interface with various sizes, shapes, and styles of plumbing fixture drain openings.

As illustrated by FIG. 1, the handle 102 is releasably connected to the plunger head 104. Any of a number of types of releasable connections may be used. For example, as illustrated by FIG. 1, the handle 102 is threadably coupled to the plunger head 104. In other implementations, the handle 102 is releasably coupled to the plunger head 104 via a snap-fit mechanism or cotter pin. In still further implementations, the handle 102 is instead permanently attached to the plunger head 104 by conventional methods such as, for example, an integrally molded handle, or a handle permanently glued, riveted, or otherwise attached to the head.

Figure 2:
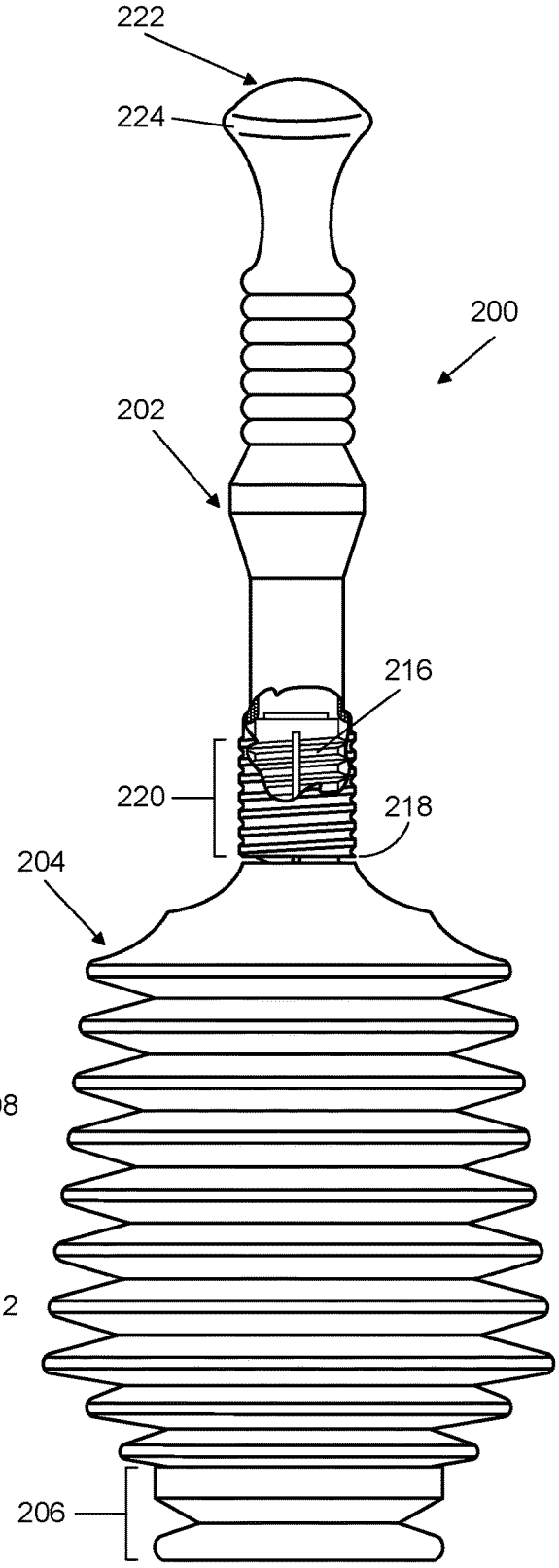
FIG. 2 is a schematic side elevation, partly broken away, with the AAR plunger of FIG. 1 shown in a standing resting condition.

In the aforementioned threaded implementation, as depicted in FIG. 2, the plunger head 204 has a threaded stud 216 extending from its top (proximal) end. The handle 202 is hollow at its proximal end 218 with threads 220 formed on its inner surface to receive the plunger head's threaded stud 216. In particular, in this implementation, the threaded stud 216 is open on both ends, thereby forming an open pathway or channel extending from the seal 206 through the plunger head 204, then through the threaded stud and into the hollow end 218 of the handle 202. The distal end 222 of the handle 202 is formed into an expanded knob 224 adapted to comfortably rest in an operator's palm when using the AAR plunger 200. Further, in another implementation, the distal end 222 of the handle 202 is ribbed to allow the operator to maintain a non-slip grip on the handle during operation. In one implementation, the handle 202 is hollow, whether permanently or releasably attached, having a central space therein to reduce its weight. In other implementations, the handle is solid throughout (with the exception of the internally threaded portion thereof), or is a combination of hollow and solid sections.

2.1 Automatic Air Release Features

The automatic air release features of the handle and plunger head of the AAR plunger are integrated into the overall plunger configuration and jointly release air from within the interior of the plunger head during compression of the plunger. For example, as applied to the implementation depicted in FIG. 3, the handle 302 is configured so that it "bottoms-out" when fully threaded onto the plunger head 304. In this bottomed-out position, a small gap 326 is left between the proximal end of the handle 302 and a shoulder 328 on the plunger head 304 located at the proximal end of the male threads 330 that screw into the female threads 332 at the proximal end of the handle. In the depicted implementation, the gap 326 exists because a ring-shaped stop 334 at the distal end of the plunger head's threaded stub 316 abuts an interior ledge 336 located at the inboard (distal) end of the handle threads 332. Air escapes out of the gap 326 as will be described in more detail in the paragraphs to follow.

Figure 3:
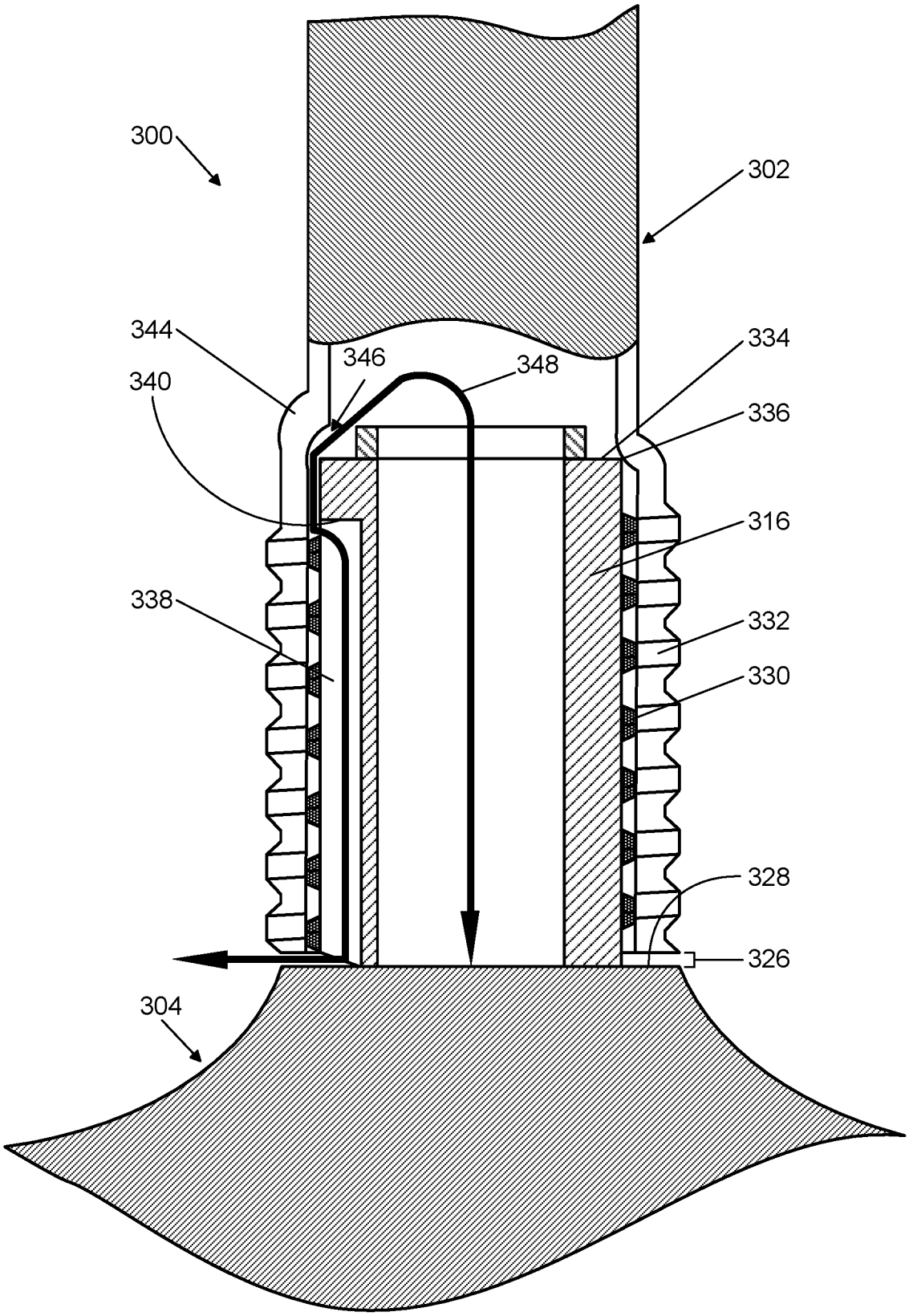
FIG. 3 is an enlarged, fragmentary, schematic side elevation, partly in cross-section, showing the AAR plunger of FIG. 1 with automatic air release features integrated into the handle and plunger head, as well as the air-escape path.
Figure 4:
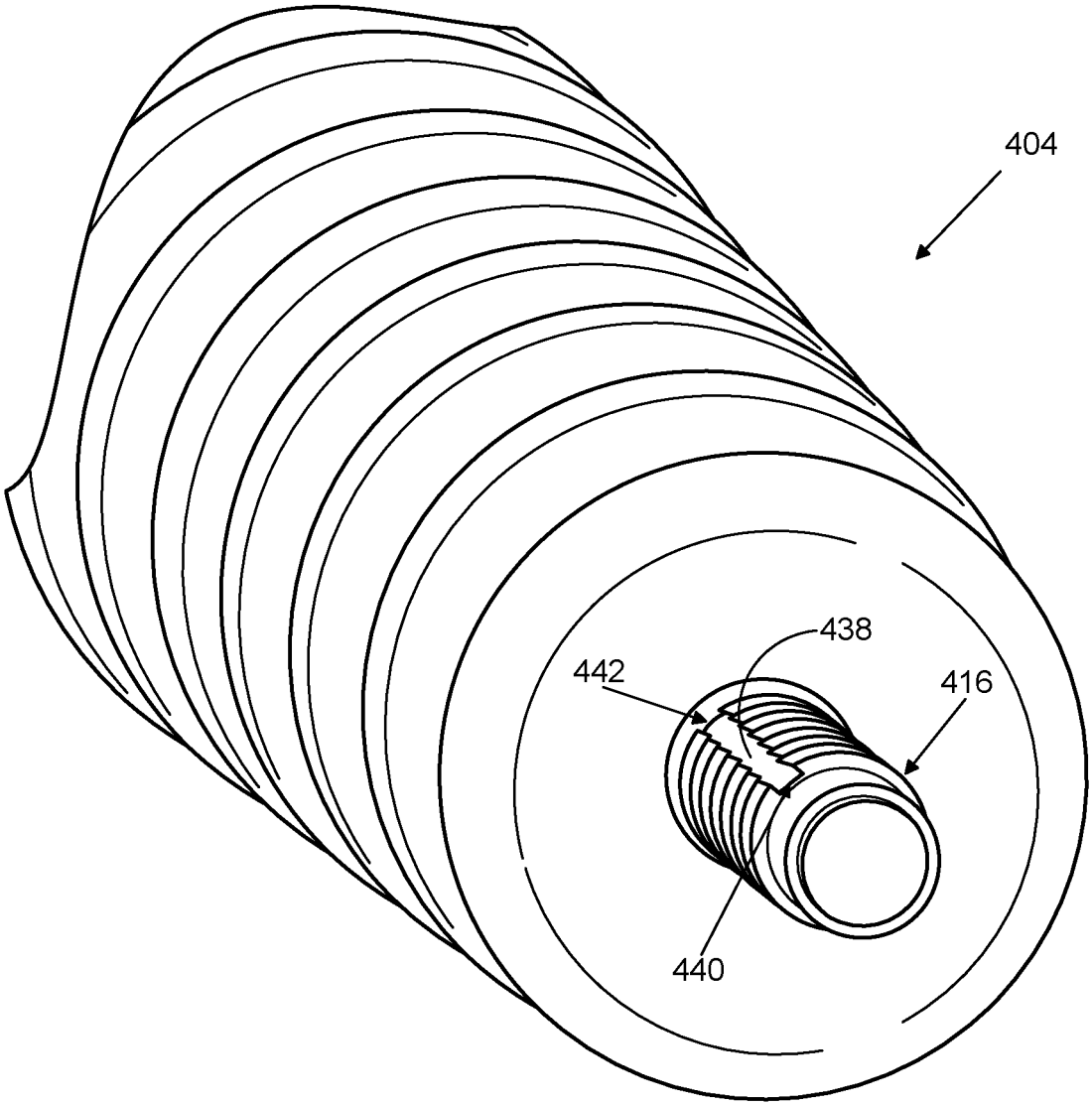
FIG. 4 is an enlarged, fragmentary, schematic perspective view, showing the plunger head of the AAR plunger of FIG. 1 with a plunger head stub slot.

The male threads 330 of the plunger head 304 include one or more slots 338. As better seen in FIG. 4, a first end 440 of each slot 438 is located at or just above the most distal male thread of the threaded stub 416 of the plunger head 404 and can be separated along the circumference of that threaded stub from other slot(s) (if there are more than one). The second end 442 of each slot is located at the bottom edge of the most proximal male thread of the threaded stub 416 and can separated along the circumference of that threaded stub from other slot(s) (if there are more than one). In one implementation having multiple slots, each slot is positioned equidistant from adjacent slots along the circumference (see FIGS. 5 and 6). In one implementation, as shown in FIG. 4, each slot 438 follows a straight line from the most distal male thread to the most proximal male thread, however this is not a requirement and a slot can follow any track through the threads (e.g., stepped, spiral, curved, and so on). The slots could even intersect other slots along their tracks through the threads. As best seen in FIG. 3, the depth of each slot 338 is such that it extends beyond the root of the threads 330 but not as far as the interior wall of the plunger head stub 316. The slots' depth can also vary along its track through the threads as long as each slot extends some distance beyond the root of the threads. When the female threaded portion of the plunger handle 302 is threaded onto the male threaded portion of the plunger head stub 316, the part of the slot 338 extending past the plunger head threads forms a channel through which air can flow. The width of each slot along the circumference of the plunger head stub can be any distance that when considered in conjunction with the width any other slots does not jeopardize the treaded attachment strength to the point that the handle would pull loose from the plunger head during an unclogging operation. A slot can also vary in width along its track through the threads. It is noted that the combination of the depth of the slot and its width at any point along its track through the threads dictates the cross-sectional area of the slot at that point. The point along a slot having the smallest cross-sectional area determines the amount of air that moves through the slot during an unclogging operation. Ultimately, the number of slots and their smallest cross-sectional areas control the amount of air that exits (or enters) the hollow interior of the plunger head during an unclogging operation.

Figure 7:
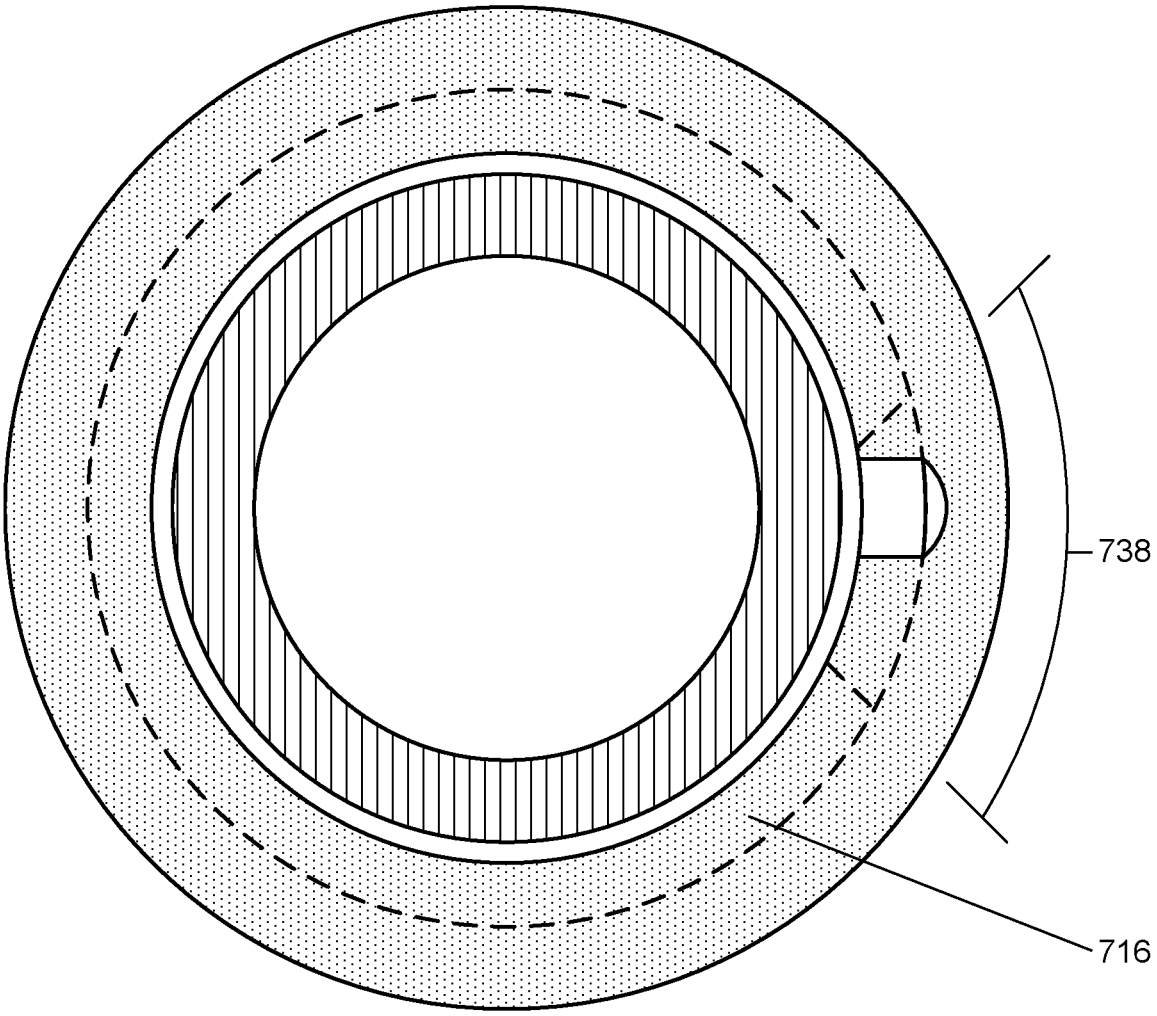
FIG. 7 is an enlarged, cross-sectional view of an AAR plunger cut through the section coupling the plunger head to the handle and showing a single void and corresponding plunger head stub slot where the slot is wider than the void so as to ensure they line up even if some rotational misalignment exists.
Figure 8:
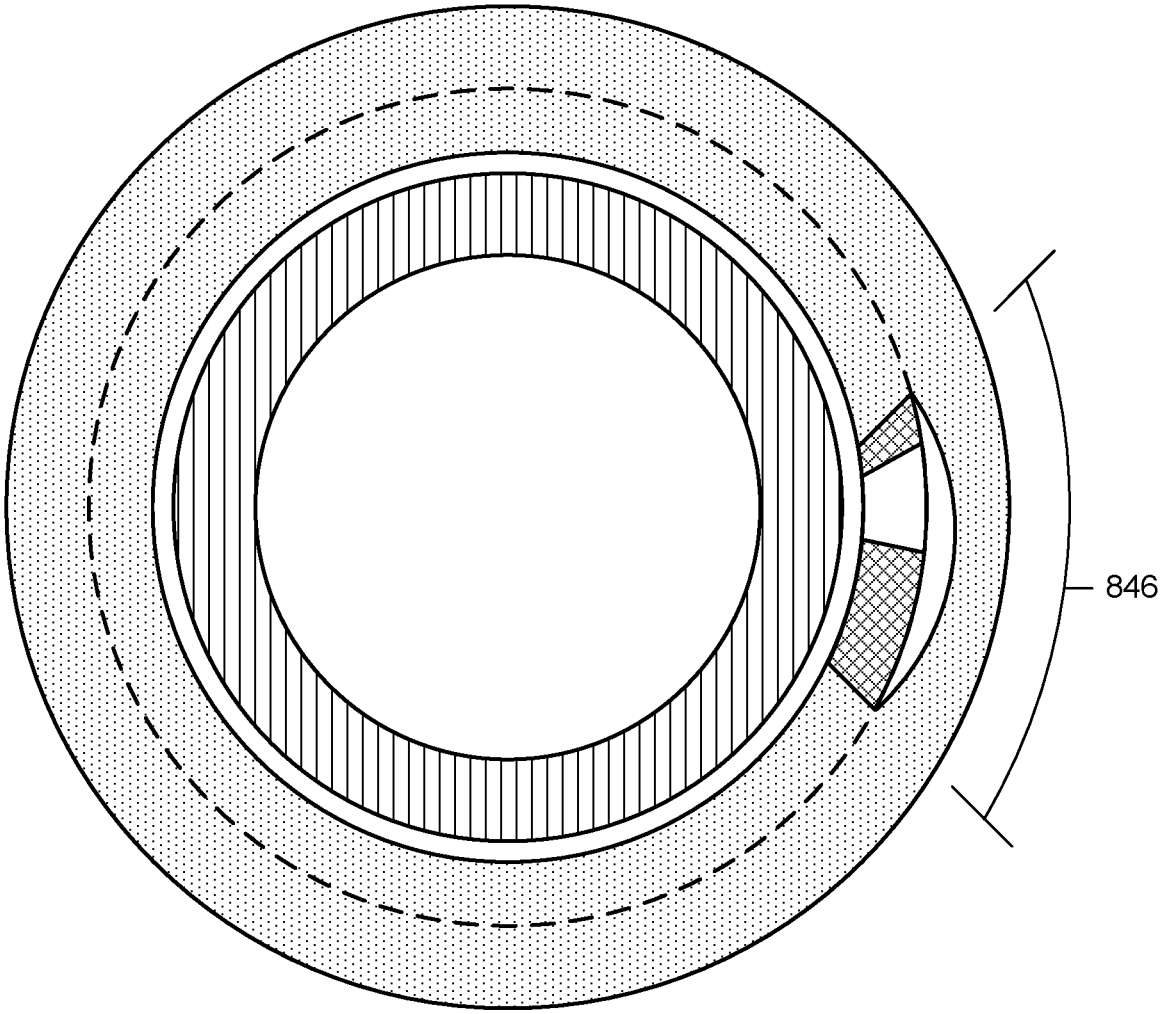
FIG. 8 is an enlarged, cross-sectional view of an AAR plunger cut through the section coupling the plunger head to the handle and showing a single void and corresponding plunger head stub slot where the void is wider than the slot so as to ensure they line up even if some rotational misalignment exists.
Figure 9:
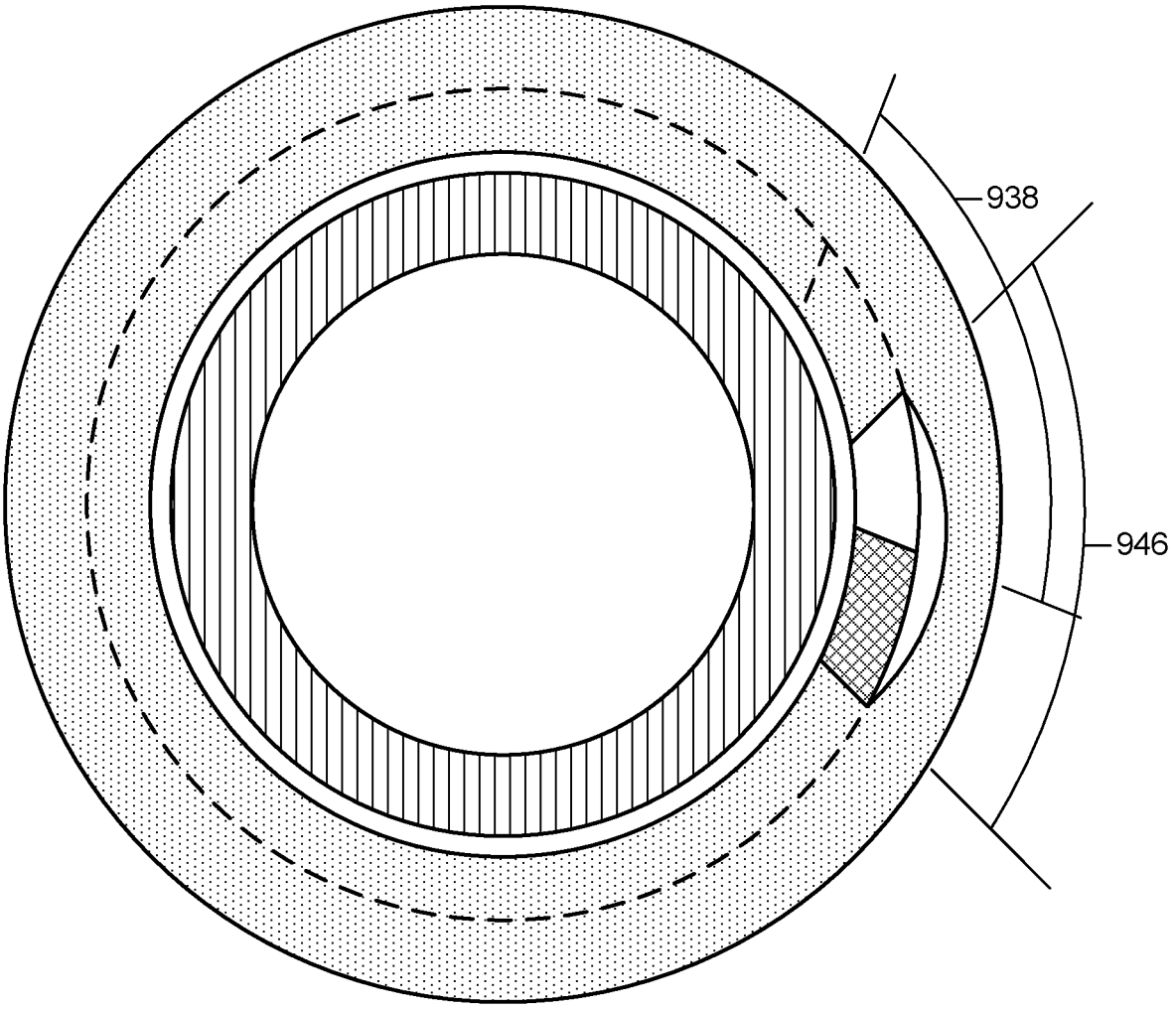
FIG. 9 is an enlarged, cross-sectional view of an AAR plunger cut through the section coupling the plunger head to the handle and showing a single void and corresponding plunger head stub slot where both the slot and the void are wide so as to ensure they line up even if some rotational misalignment exists.

Referring to FIG. 3 once again, there is a projection 344 (144 in FIG. 1) along the circumference of the exterior part of the proximal portion of the plunger handle 302. The projection 344 is hollow and forms a void 346 in the inner wall of the handle 302 inboard of and opening into the interior ledge 336 of the handle. In some implementations, the projection 344/void 346 lines up with the first end 340 of a slot at or just above the most distal male thread of the threaded stub 316 of the plunger head 304. In one implementation, this is accomplished by configuring the ring-shaped stop 334 at the distal end of the male threaded stub 316 of the plunger head 304 so that it contacts the interior ledge 336 of the handle 302 in a manner that prevents further rotation of the handle onto the plunger head 304 at a rotational position where the plunger head slot 338 lines up with a corresponding handle projection void 346. In other implementations not employing a threaded connection between the handle and plunger head, the alignment of each plunger head slot with a corresponding handle projection void is accomplished in an appropriate manner. Ideally, the centerline of the plunger head slot 338 at or just above the most distal male thread of the threaded stub 316 would align with the centerline of the corresponding handle projection void 346. However, some misalignment can be tolerated as long as the air-escape path is not compromised to an unacceptable degree (e.g., the total amount of air flow from the interior of the plunger head is less than desired). In one implementation shown in FIG. 7, this issue is addressed by making the width of a plunger head slot 738 at or just above the most distal male thread of the threaded stub 716 of the plunger head wide enough to allow for a reasonable amount of rotational misalignment. In another implementation shown in FIG. 8, the misalignment issue is addressed by making the circumferential width of the handle projection void 846 wide enough to allow for a reasonable amount of rotational misalignment. In some implementations (such as shown in FIG. 9), both the width of the plunger head slot 938 and the handle projection void 946 are made wide enough to allow for a reasonable amount of rotational misalignment.

The foregoing alignment allows air to more easily flow from the inside of the hollow plunger head 304 into the handle 302, then between the interior surface of the handle above its proximal-most thread and the exterior surface of the plunger head stub 316 above its distal-most thread during compression of the plunger head. It is noted that air does not flow into the mating threads of the handle and plunger head stub because the threads form a substantially air-tight seal. Instead, air then flows into the void 346 and through the plunger handle's interior ledge 336. In some implementations, the void 346 interfaces with the slot 338 in the male threads 330 of the plunger head 304. Thus, the void 346 allows air to directly enter the slot 338. The air then follows the slot 338 and exits the AAR plunger 300 via the gap 326 between the plunger head shoulder 328 and the proximal end of the handle 302. During expansion of the plunger head, air flows along the same air-escape path, but in the reverse direction. The air-escape path is shown by the two-way path line 348 in FIG. 3. It is noted that even if the handle void did not line up with the plunger head stub slot, air would still enter the cylindrical-shaped space between the interior surface of the handle above its proximal-most thread and the exterior surface of the plunger head stub above its distal-most thread, and eventually find its way to the plunger head stub slot. However, this cylindrical-shaped space can be narrow and thereby restrict the flow of air compared to implementations where the handle void(s) line up with the plunger head stub slot(s).

Figure 5:
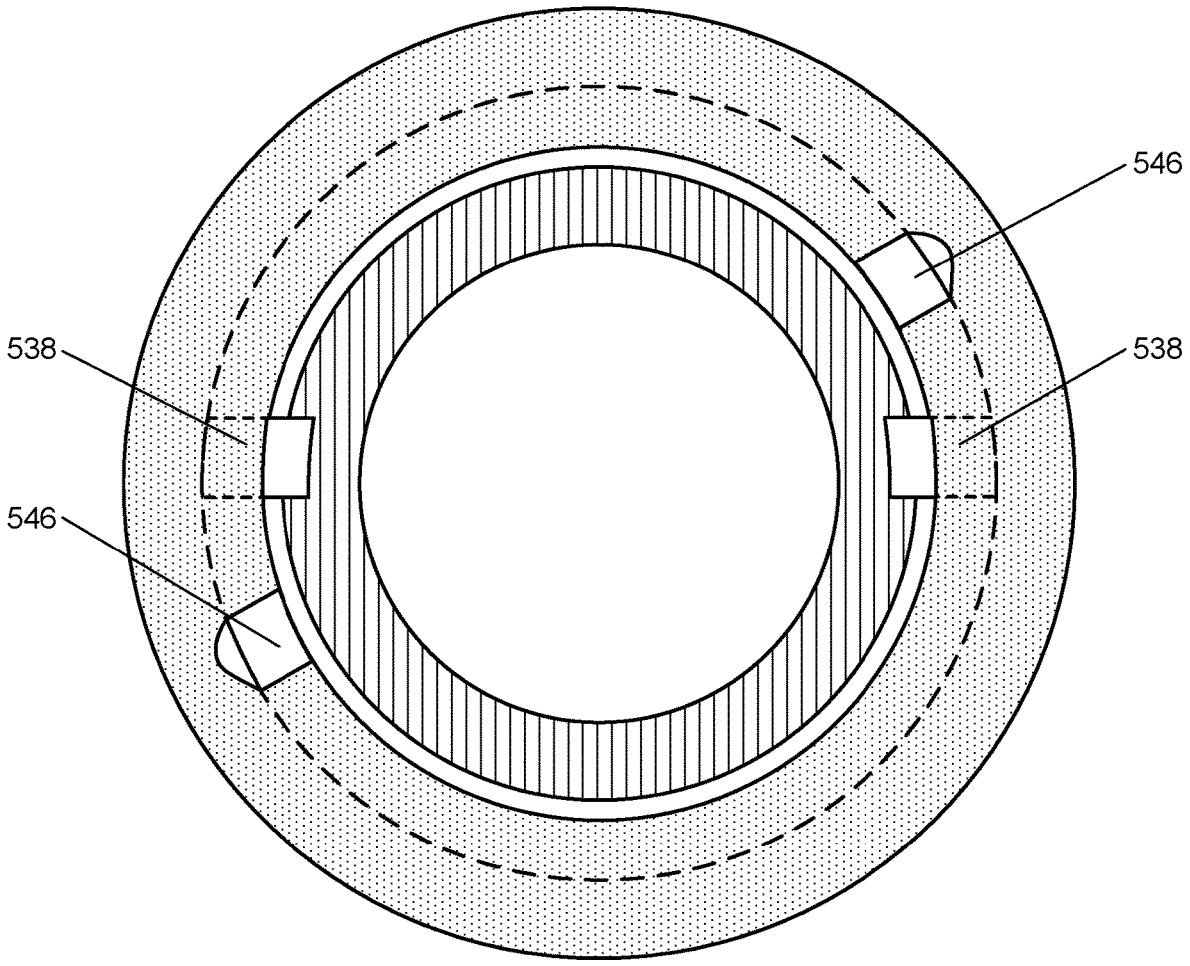
FIG. 5 is an enlarged, cross-sectional view of an AAR plunger cut through the section coupling the plunger head to the handle and showing two handle voids and corresponding plunger head stub slots in a rotational position where they do not yet line up.
Figure 6:
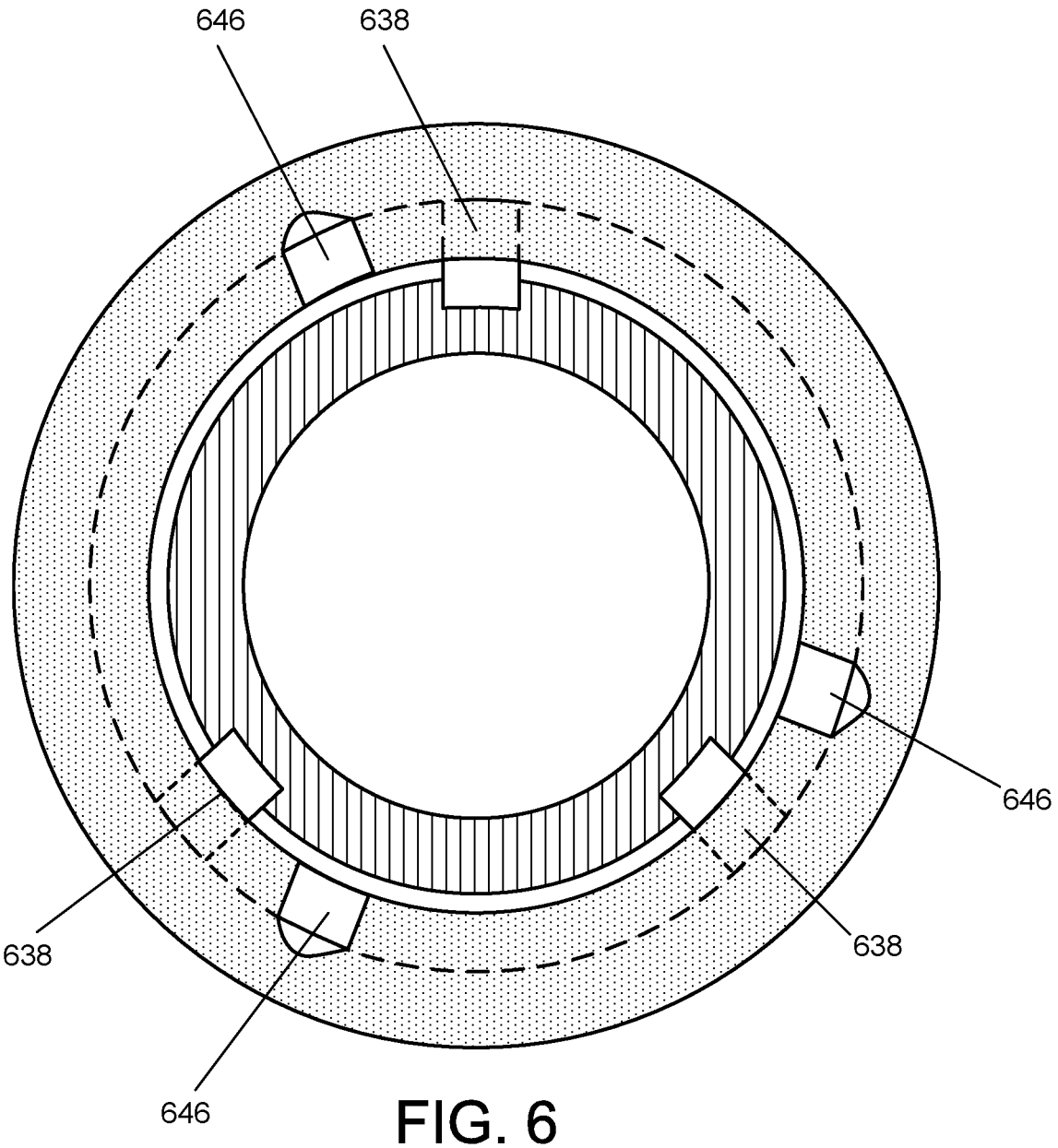
FIG. 6 is an enlarged, cross-sectional view of an AAR plunger cut through the section coupling the plunger head to the handle and showing three handle voids and corresponding plunger head stub slots in a rotational position where they do not yet line up.

In some implementations with multiple plunger head stub slots, there is a corresponding handle projection/void for each slot. More particularly, implementations with two slots 538 and two projection voids 546, or three slots 638 and three projection voids 646 (as shown in FIGS. 5 and 6, respectively) are envisioned. Note that in FIGS. 5 and 6, the handle and plunger head stub are shown in a rotationally misaligned condition so that both the slots and voids can be seen. Further, while not shown in the figures, even more than 3 slots are possible in some implementations, as long as the combined width of the slots does not jeopardize the connection between the handle and the plunger head.

3.0 Automatic Air Release Plunger Operation

An operator of an AAR plunger generally unclogs a plumbing fixture drain by placing the plunger into position above a clogged drain such that the plunger head seal interfaces with the opening of the drain. Thus, at least part of the AAR plunger head is surrounded by undrained wastewater. The previously-described automatic air release features of the AAR plunger provide a considerable advantage during the insertion of the plunger into a clogged plumbing fixture. When the AAR plunger is inserted into the undrained wastewater and pushed toward the drain opening, the wastewater exerts a force on the air trapped inside the hollow plunger head. The automatic air release features allow the air inside the plunger head to escape in a controlled manner, thus allowing wastewater to begin filling the plunger head. More particularly, air from inside the plunger head flows out of the open end of the plunger head stub and into the handle. Air then flows between the interior surface of the threaded portion of the handle and the exterior surface of the plunger head stub, and from there through the one or more handle projection voids, then through the handle ledge and into one or more of the slot(s) in plunger head stub. The air then exits the AAR plunger via the previously-described gap between the plunger head shoulder and the distal end of the handle. Absent this release of air from the plunger head, the volume of the plunger head structure and the air trapped inside the plunger head would cause a significant rise in the undrained wastewater level within the plumbing fixture owing to displacement of the wastewater. The rise in wastewater level could result in it overflowing from the fixture onto surrounding surfaces and floor—an occurrence often referred to as "spillover".

In one implementation of the seal, such as illustrated in FIG. 1, as the seal 106 is inserted into the drain opening of the clogged plumbing fixture, the seal deforms to form a pressure seal with the edges of the drain opening and the surface surrounding the drain opening. The deformation of the seal 106 thus creates an interference fit/mechanical seal and a pressure seal between the seal and the drain opening. As the operator pushes down on the handle 102, the plunger head 104 is compressed. The pressure generated by compression of the plunger head 104 is directed through the seal 106 and into the drain in the direction of the obstruction that is clogging the drain. As the plunger head 104 is compressed, the automatic air release features facilitate a controlled release of the air still remaining air in the hollow interior of the plunger head as described previously. This controlled release of air prevents the undrained wastewater in the plumbing fixture from being excessively churned as could occur if there were no automatic air release features and the air-water mixture inside the head instead escapes suddenly from between the drain opening and the plunger head seal 106. Excessive churning of the wastewater could result in some of it escaping the plumbing fixture—an occurrence often referred to as "backsplash". In addition, in implementations where the plunger head is completely or partially formed from a bellows, the plunger tends to bend at an angle to the drain on the compression stroke if the air inside the plunger head cannot escape, thereby potentially causing churning of the wastewater in the plumbing fixture and a backsplash. The automatic air release features prevent this from occurring.

Next, the handle 102 is then pulled upwards. This expands the plunger head 104 and applies a suction force on to the obstruction in the drain. The suction force in the drain enhances the pressure seal between the seal 106 and the drain opening, thereby preventing the plunger from lifting away from the drain. In addition, the automatic air release features allow some air to re-enter the plunger head via the foregoing path in the reverse direction.

The downward and upward motions of the handle 102 are repeated creating reciprocating pressure and suction forces that dislodge the obstruction from within the drain. The dislodged obstruction then is typically is drawn down the drain pipe when the plunger is removed, thus clearing of the drain.

The automatic air release features have a further advantage of ensuring that the plunger head is mostly filled with wastewater during each compression stroke and that there is little or no air upstream from the obstruction in the drain during each expansion stroke. The fact that the air initially residing inside the hollow plunger head is released as described above and replaced with wastewater has the advantage of placing a much stronger pressure force on the obstruction that would air (or a mixture of mostly air with some water) during a compression stroke owing to the greater weight and greater incompressibility of the water. The same is true when the plunger head is expanded during an unclogging operation as the water's higher incompressibility will cause a stronger suction force to be exerted on the obstruction than would with air (or a mixture of mostly air with some water).

It is noted that the speed at which the plunger head is initially compressed during an unclogging operation should ideally be such that the undrained water in the plumbing fixture is not agitated to a degree that some of it spills out. This compression speed will at least partially depend on the amount of air displaced from the interior of the hollow plunger head over time via the previously-described air-escape path. The amount of air displaced per exit point over time during the initial compression stroke is generally dependent on the narrowest cross-sectional part of each of the air-release paths. It is also noted that generally, the more air displaced over time during the initial compression stroke of an unclogging operation, the faster the compression stroke can be accomplished, thereby potentially making the unclogging operation easier for the operator of the plunger. However, during the expansion stroke of the unclogging operation, some air can be drawn into the hollow interior of the plunger body through each of air-release path. As long as the amount of water/air drawn in through the air-release path(s) does not significantly affect the amount of water drawn in to the hollow interior of the plunger body from the drain of the sink or toilet being unclogged to the point that the suction force exerted on the drain obstruction is unacceptably diminished.

It is also noted that some of the water drawn inside of the hollow plunger body might follow the previously described air-release path and exit via the gap between the plunger head's shoulder and the proximal end of the handle during depression of the plunger body. However, this water will be directed sideways into the plumbing fixture (as opposed to upward and possibly out), and of no significance as long as the amount of water directed out through the air-release path(s) does not significantly affect the amount of water pushed into the clogged drain from the hollow interior of the plunger body to the point that the pressure force exerted on the drain obstruction is unacceptably diminished.

4.0 Additional Implementations

Figure 10:
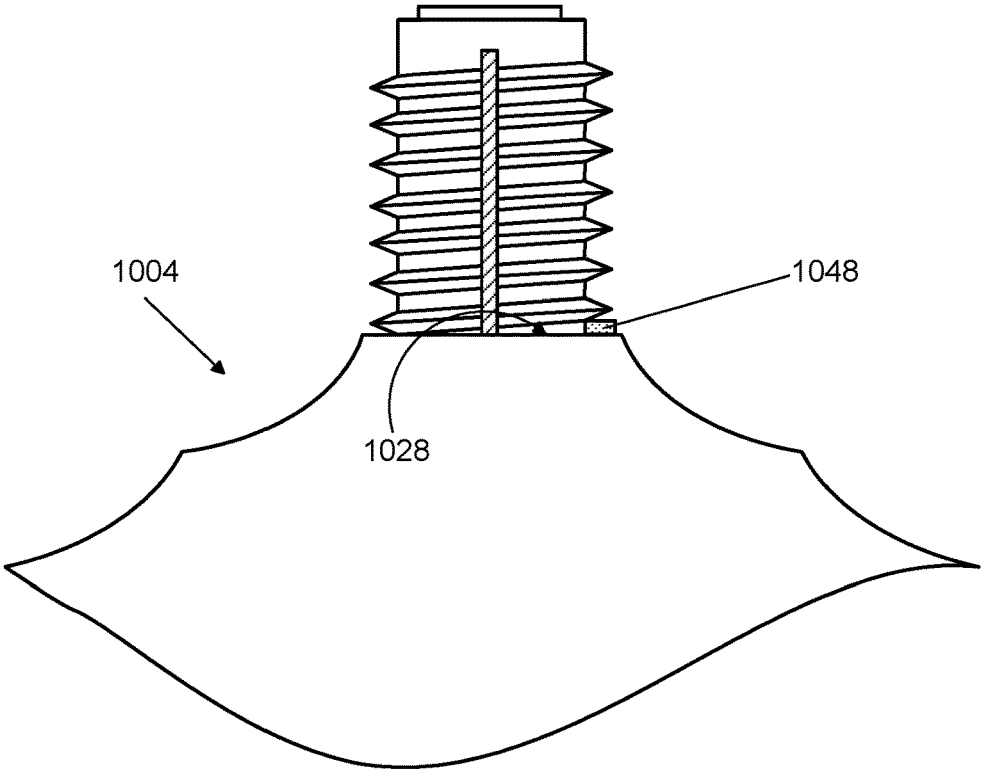
FIG. 10 is an enlarged, fragmentary, schematic side elevation, of the plunger head of an AAR plunger showing a shoulder tab.
Figure 11:
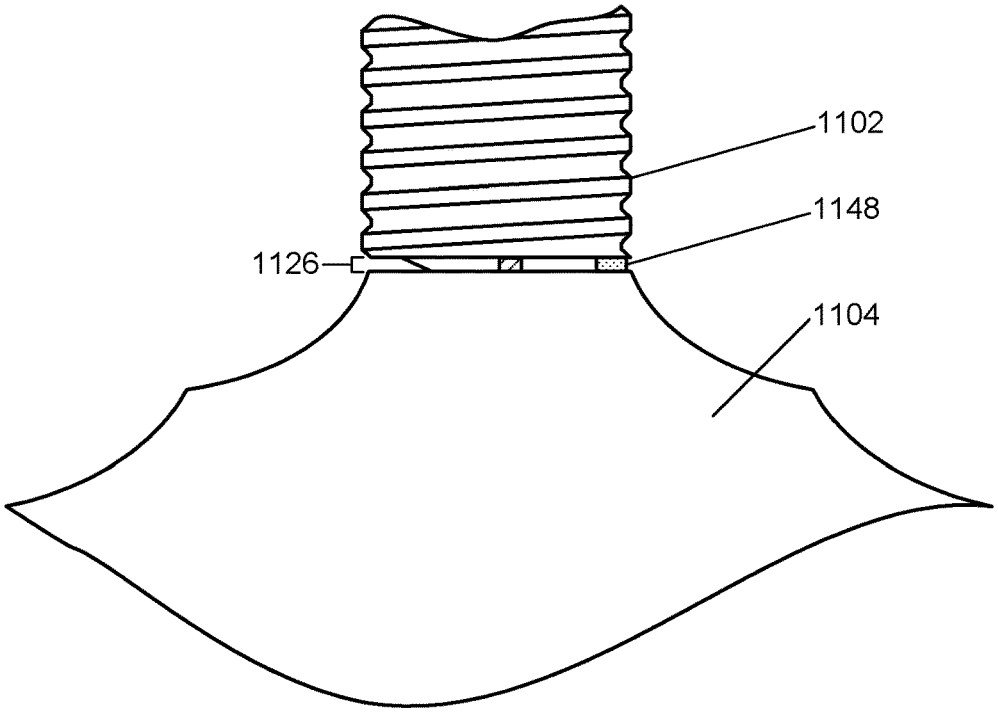
FIG. 11 is an enlarged, fragmentary, schematic side elevation, of an AAR plunger showing the proximal end of the handle in contact with a shoulder tab thereby creating a gap between the proximal end of the handle and the plunger head shoulder.

While the AAR plunger described so far employs a ring-shaped stop at the distal end of the male threaded stub of the plunger body to abut the interior ledge located at the inboard end of the handle threads, a shoulder tab feature can be employed in conjunction with or in lieu of the ring-shaped stop. In one implementation, the shoulder tab feature takes the form of one or more projections originating from the shoulder of the plunger head and directed generally perpendicular to the shoulder. Each projection has a length that when it abuts the proximal end of a fully installed plunger handle creates the desired gap between the proximal end of the handle and the shoulder of the plunger head. Air can escape out of the gap as described previously. FIG. 10 shows one implementation where a single shoulder tab 1048 extends from the shoulder 1028 of the plunger head 1004. FIG. 11 illustrates the gap 1126 formed by the shoulder tab 1148 when the handle 1102 is fully installed on the plunger head 1104. In yet another implementation (not shown in the figures), the shoulder tab projects from the proximal end of the handle instead of from the shoulder of the plunger head. The resulting gap is the same.

Figure 12:
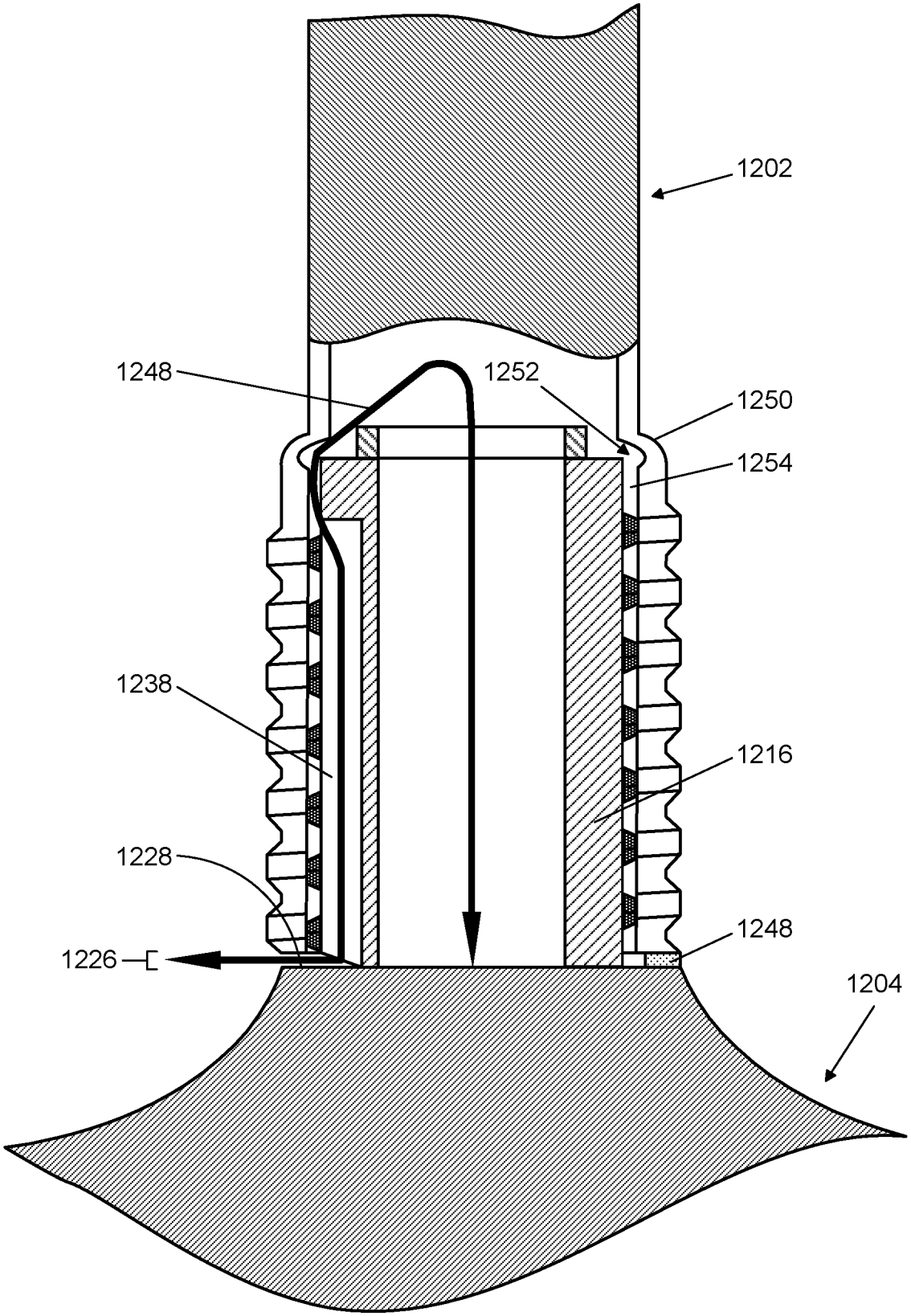
FIG. 12 is an enlarged, fragmentary, schematic side elevation, partly in cross-section, showing a AAR plunger with the proximal end of the handle in contact with a tab thereby creating a gap between the proximal end of the handle and the plunger head shoulder, as well as a ring-shaped void and the air-escape path.

Referring now to FIG. 12, in yet another implementation, the previously-described alignment issue between the plunger head slot(s) and handle's projection/voids is eliminated by replacing the individual handle projection(s) with a ring-shaped projection 1250 having an interior void 1252 that wraps around the circumference of the handle 1202 and which opens into the space 1254 between the interior surface of the handle 1202 above its proximal-most thread and the exterior surface of the plunger head stub 1216 above its distal-most thread. In this way, the exact rotational alignment of a plunger head slot 1238 with the handle 1202 becomes irrelevant. In other words, no matter where the slot 1238 (or slots if there are more than one) aligns with the handle 1202, a relatively larger air-release path is created through the handle's ring-shaped projection void 1252 so that air from the interior of the plunger head 1204 can enter the slot and exit out the gap 1226 between the proximal end of the handle and a shoulder 1228 on the plunger head. Additionally, in this implementation, the previously-described shoulder tab 1248 is employed rather than the previously-described ring-shaped stop at the distal end of the plunger head stub 1216 to create the air-escape gap 1226. This air-escape path is shown by the two-way path line 1248 in FIG. 12.

Figure 13:
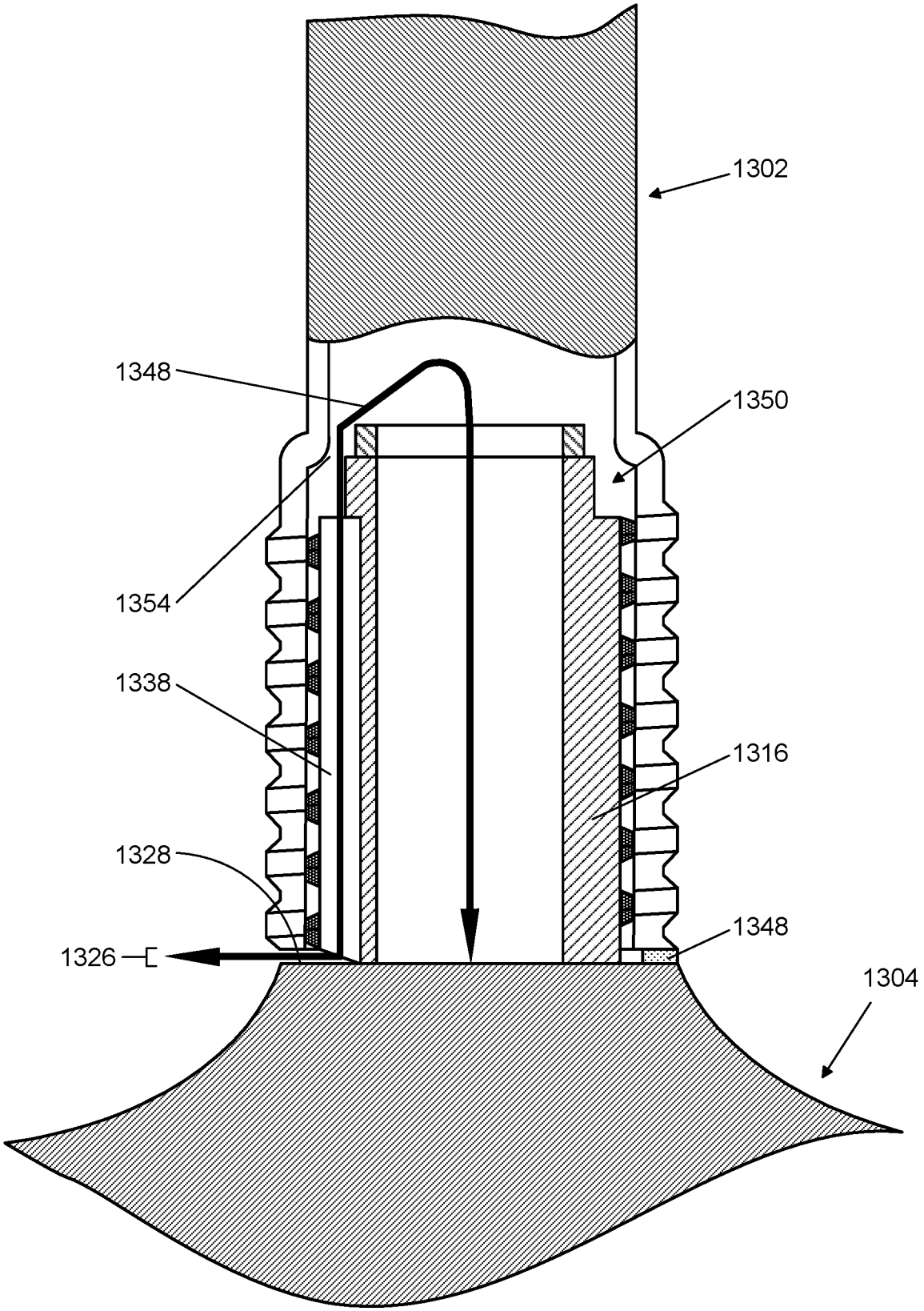
FIG. 13 is an enlarged, fragmentary, schematic side elevation, partly in cross-section, showing a AAR plunger with the proximal end of the handle in contact with a tab thereby creating a gap between the proximal end of the handle and the plunger head shoulder, as well as an annular indentation close to the distal end of the plunger head stub and the air-escape path.

Referring now to FIG. 13, in yet another implementation, the previously-described alignment issue between the plunger head slot(s) and handle's projection/voids is eliminated by replacing the individual handle projection(s) with an annular indentation 1350 that wraps around the circumference of the plunger head stub 1316 close to its distal end and which opens into the space 1354 between the interior surface of the handle 1302 above its proximal-most thread and the exterior surface of the plunger head stub 1316 above its distal-most thread. In this way, the exact rotational alignment of a plunger head slot 1338 with the handle 1302 becomes irrelevant. In other words, no matter where the slot 1338 (or slots if there are more than one) aligns with the handle 1302, a relatively larger air-release path is created through the annular indentation 1350 so that air from the interior of the plunger head 1304 can enter the slot and exit out the gap 1326 between the proximal end of the handle and a shoulder 1328 on the plunger head. Additionally, in this implementation, the previously-described shoulder tab 1348 is employed rather than the previously-described ring-shaped stop at the distal end of the plunger head stub 1316 to create the gap 1326. The resulting air-escape path is shown by the two-way path line 1348 in FIG. 13.

It is also noted that although the foregoing subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What has been described above includes example implementations. It is, of course, not possible to describe every conceivable combination of components or methodologies for purposes of describing the claimed subject matter, but one of ordinary skill in the art may recognize that many further combinations and permutations are possible. Accordingly, the claimed subject matter is intended to embrace all such alterations, modifications, and variations that fall within the spirit and scope of the appended claims.

The aforementioned implementations have been described with respect to interaction between several components. It will be appreciated that such implementations and components can include those components or specified sub-components, some of the specified components or sub-components, and/or additional components, and according to various permutations and combinations of the foregoing. Sub-components can also be implemented as components coupled to other components rather than included within parent components (e.g., hierarchical components).

Wherefore, what is claimed is:

1. An automatic air release plunger for unclogging an obstructed drain in a plumbing fixture having undrained wastewater therein, comprising:

a handle; and a hollow, compressible plunger head that is open at both a proximal and distal end and coupled to the handle at the proximal end of the plunger head and comprising a seal extending from the distal end of the plunger head, said seal capable of sealing the plunger head to a drain opening of the plumbing fixture; and wherein the handle and plunger head comprise automatic air release features that allow air to flow along an air-escape path from the inside of the hollow plunger head into a void formed in an interior surface of a coupling section of the handle and thereafter into a channel which extends from the proximal end of the plunger head to a permanently open gap that is open to the exterior of the plunger at a proximal end of the handle whenever the plunger head is compressed.

2. The automatic air release plunger of claim 1, wherein the proximal end of the plunger head comprises a hollow stub having a coupling section that fits within the coupling section which forms a proximal portion of the handle and which comprises a hollow interior, and wherein the channel comprises a slot that begins at a first end of the coupling section of the stub closest to the proximal end of the plunger head and ends at a second end of the coupling section of the stub farthest from the proximal end of the plunger head.

3. The automatic air release plunger of claim 2, wherein the slot follows a straight path from the first end of the coupling section of the stub to the second end of the coupling section of the stub.

4. The automatic air release plunger of claim 2, wherein the coupling section of the stub comprises male treads and the coupling section of the handle comprises female thread which thread onto the male threads of the stub to couple the handle to the plunger head.

5. The automatic air release plunger of claim 4, wherein the plunger head stub slot extends from an outermost extent of the male threads inward past the thread roots and into the stub to a depth not penetrating an inner wall of the hollow stub.

6. The automatic air release plunger of claim 4, wherein the hollow coupling section of the handle comprises a ledge at the distal-most end of the hollow coupling section of the handle, and wherein the plunger head comprises a shoulder located at the distal-most end of the plunger head stub and a stop at the proximal-most end of the plunger head stub, and wherein the plunger head stop interferes with the handle ledge whenever the handle threads are fully threaded onto the plunger head threads, such that the void in an interior surface of a coupling section of the handle lines up with a first end of the plunger head stub slot so that air from the inside of the hollow plunger head flows into the void and thereafter into the slot whenever the plunger head is compressed.

7. The automatic air release plunger of claim 2, further comprising a projection extending from an exterior surface of the coupling section of the handle which comprises a hollow interior that opens into the hollow interior of the coupling section of the handle, said hollow interior of the projection forming said void formed in the interior surface of the coupling section of the handle.

8. The automatic air release plunger of claim 7, wherein the location where the hollow interior of the projection opens into the hollow interior of the coupling section of the handle lines up with a first end of the plunger head stub slot such that air from the inside of the hollow plunger head flows into the hollow interior of the projection and thereafter into the slot.

9. The automatic air release plunger of claim 8, wherein the first end of the plunger head stub slot is made wide enough to ensure that the slot at least partially opens into the hollow interior of the projection.

10. The automatic air release plunger of claim 8, wherein the hollow interior of the projection is made large enough to ensure the hollow interior of the projection at least partially opens into the first end of the plunger head stub slot.

11. The automatic air release plunger of claim 2, wherein the coupling section of the handle comprises a ledge at the distal-most end of the coupling section of the handle, and wherein the plunger head comprises a shoulder located at a proximal-most end of the plunger head stub and a stop at the distal-most end of the plunger head stub, and wherein the plunger head stop interferes with the handle ledge so as to create the gap between the proximal end of the handle and the shoulder of the plunger head such that air flows from a second end of the plunger head stub slot located at the second end of the coupling section of the stub farthest from the proximal end of the plunger and out of the automatic air release plunger via the gap.

12. The automatic air release plunger of claim 2, wherein the plunger head comprises a shoulder located at a proximal-most end of the plunger head stub and having a tab projecting toward the handle, and wherein the plunger head shoulder tab interferes with the proximal end of the handle so as to create the gap between the proximal end of the handle and the shoulder of the plunger head such that air flows from a second end of the plunger head stub slot located at the second end of the coupling section of the stub farthest from the proximal end of the plunger head and out of the automatic air release plunger via the gap whenever the plunger head is compressed.

13. The automatic air release plunger of claim 2, wherein the plunger head comprises a shoulder located at a proximal-most end of the plunger head stub, and the handle comprises a tab at the proximal end thereof that projects toward the plunger head shoulder, and wherein the handle tab interferes with the plunger head shoulder so as to create the gap between the proximal end of the handle and the shoulder of the plunger head such that air flows from a second end of the plunger head stub slot located at the second end of the coupling section of the stub farthest from the proximal end of the plunger and out of the automatic air release plunger via the gap whenever the plunger head is compressed.

14. An automatic air release plunger for unclogging an obstructed drain in a plumbing fixture having undrained wastewater therein, comprising:

a handle; and a hollow, compressible plunger head that is open at both a proximal and distal end and coupled to the handle at the proximal end of the plunger head and comprising a seal extending from the distal end of the plunger head, said seal capable of sealing the plunger head to a drain opening of the plumbing fixture; and wherein the handle and plunger head comprise automatic air release features that allow air to flow along multiple air-escape paths from the inside of the hollow plunger head into multiple voids formed in an interior surface of a coupling section of the handle and thereafter into channels which extends from the proximal end of the plunger head to a gap that is open to the exterior of the plunger at a proximal end of the handle whenever the plunger head is compressed.

15. The automatic air release plunger of claim 14, wherein the proximal end of the plunger head comprises a hollow stub having a coupling section that fits within a coupling section forming a proximal portion of the handle, and wherein the channels comprises multiple slots, each of which begins at a first end of the coupling section of the stub closest to the proximal end of the plunger head and ends at a second end of the coupling section of the stub farthest from the proximal end of the plunger.

16. The automatic air release plunger of claim 15, wherein the coupling section of the stub comprises male treads and the coupling section of the handle comprises female thread which thread onto the male threads of the stub to couple the handle to the plunger head.

17. The automatic air release plunger of claim 16, wherein the coupling section of the handle comprises a ledge at the distal-most end of the coupling section of the handle, and wherein the plunger head comprises a shoulder located at a proximal-most end of the plunger head stub and a stop at the distal-most end of the plunger head stub, and wherein the plunger head stop interferes with the handle ledge whenever the handle threads are fully threaded onto the plunger head threads, such that each of the voids formed in the interior surface of the coupling section of the handle lines up with a first end of a different one of the plunger head stub slots so that air from the inside of the hollow plunger head flows into each void and thereafter into a correspondingly-located slot whenever the plunger head is compressed.

18. The automatic air release plunger of claim 15, further comprising multiple projections, each projection extending from an exterior surface of the coupling section of the handle and comprising a hollow interior that opens into the hollow interior of the coupling section of the handle, said hollow interior of each projection forming a different one of the multiple voids formed in the interior surface of the coupling section of the handle.

19. The automatic air release plunger of claim 18, wherein the locations where the hollow interior of each projection open into the hollow interior of the coupling section of the handle corresponds to a first end of a different one of the plunger head stub slots such that, for the hollow interior of each projection, air from the inside of the hollow plunger head flows into the hollow interior of the projection and thereafter into the correspondingly-located slot whenever the plunger head is compressed.

20. An automatic air release plunger for unclogging an obstructed drain in a plumbing fixture having undrained wastewater therein, comprising:

a handle; and a hollow, compressible plunger head that is open at both a proximal and distal end and coupled to the handle at the proximal end of the plunger head and comprising a seal extending from the distal end of the plunger head, said seal capable of sealing the plunger head to a drain opening of the plumbing fixture; and wherein the handle and plunger head comprise automatic air release features that allow air to flow along an air-escape path from the inside of the hollow plunger head into a void formed in the interior of the handle and thereafter into one or more channels which extend from the proximal end of the plunger head to a gap that is open to the exterior of the AAR plunger at a proximal end of the handle whenever the plunger head is compressed, said automatic air release features comprising a single hollow ring-shaped projection that wraps around the circumference of the handle and forms the void, and a shoulder located at a proximal-most end of the plunger head stub, and a tab that interferes with the shoulder of the plunger head and the proximal end of the handle so as to create said gap therebetween.

21. The automatic air release plunger of claim 20, wherein the tab projects toward the proximal end of the handle from the plunger head shoulder.

22. The automatic air release plunger of claim 20, wherein the tab projects from the proximal end of the handle toward the plunger head shoulder.

23. An automatic air release plunger for unclogging an obstructed drain in a plumbing fixture having undrained wastewater therein, comprising:

a handle; and a hollow, compressible plunger head that is open at both a proximal and distal end and coupled to the handle at the proximal end of the plunger head and comprising a seal extending from the distal end of the plunger head, said seal capable of sealing the plunger head to a drain opening of the plumbing fixture; and wherein the handle and plunger head comprise automatic air release features that allow air to flow along an air-escape path from the inside of the hollow plunger head into a void formed in the interior of the handle and thereafter into one or more channels which extend from the proximal end of the plunger head to a gap that is open to the exterior of the AAR plunger at a proximal end of the handle whenever the plunger head is compressed, said automatic air release features comprising an annular indentation that wraps around the circumference of the plunger head stub, and a shoulder located at a proximal-most end of the plunger head stub, and a tab that interferes with the shoulder of the plunger head and the proximal end of the handle so as to create said gap therebetween.

24. The automatic air release plunger of claim 23, wherein the tab projects toward the proximal end of the handle from the plunger head shoulder.

25. The automatic air release plunger of claim 23, wherein the tab projects from the proximal end of the handle toward the plunger head shoulder.

* * * * *